US005931505A

United States Patent [19]

Malpass et al.

[11] Patent Number: 5,931,505

[45] Date of Patent: Aug. 3, 1999

[54] CASING FOR BINDERS AND BOOKS

[75] Inventors: Thomas H. Malpass, Ottawa; John Pelszynski, LaSalle; Ronald V. Mounts, Chicago, all of Ill.

[73] Assignee: Industrial Coatings Group, Inc., Chicago, Ill.

[21] Appl. No.: 08/798,771

[22] Filed: Feb. 11, 1997

Related U.S. Application Data

[60] Provisional application No. 60/011,516, Feb. 12, 1996.

[51] Int. Cl.[6] ..... B42D 3/02

[52] U.S. Cl. ..... 281/29; 281/37; 281/36; 281/27; 281/28; 281/15.1; 428/122; 428/323; 428/500

[58] Field of Search ..... 281/29, 37, 36, 281/27, 28, 15.1; 428/122, 323, 500

[56] References Cited

U.S. PATENT DOCUMENTS 5,224,737 7/1993 McCurdy et al. .

*Primary Examiner*—Willmon Fridie, Jr.
*Assistant Examiner*—Mark T. Henderson
*Attorney, Agent, or Firm*—Lee, Mann, Smith, McWilliams, Sweeney & Ohlson

[57] ABSTRACT

A casing for a binder or book is disclosed in which there is at least one stiff panel portion and a thermoplastic sheet for covering the panel portion with the end and/or edge portions of the sheet being folded under and secured to the underside of the panel portions. The sheet comprises between about 30% and about 55% copolymer of propylene and ethylene; from 0% to about 12% propylene homopolymer; between 0% to about 20% high density polyethylene; between about 23% and about 35% calcium carbonate or talc filler. The product is especially adapted for high speed machines for making binder casings.

17 Claims, 1 Drawing Sheet

CASING FOR BINDERS AND BOOKS

BACKGROUND OF THE INVENTION

This application is based upon and claims priority from provisional application Ser. No. 60/011,516 filed Feb. 12, 1996.

This invention relates to a casing for a loose leaf binder, book or the like. Casings for books have included various kinds of covering materials including various kinds of fabrics, leathers and thermoplastic sheets which cover the exterior sides of and are turned under and glued to the underside of a cover filler board in order to bond the covering material to the filler board and form the casing. The material selected for the covering material for the casing must be a material which can be readily formed and stamped as well as a material which can be handled in fast moving production equipment which mass produces the hard covers for books and binders or the like.

In U.S. Pat. No. 5,224,737 there is described a protective integral cover material used with a filler board to form the casing for a hard cover book or the like. The material is a thermoplastic nonwoven sheet comprising between about 60% to about 85% by weight of polypropylene homopolymer; between about 12% to about 32% by weight calcium carbonate and between about 3% to about 12% weight of a polyolefin carrier, preferably linear low density polyethylene. This material has proved excellent for hard cover books. However, when attempting to use this type of material in high speed equipment, it is clear that there is a need for a product which can be even more easily cut, form well in gutters and have very little tendency to stick to the hot letter stamp as well as avoiding the blocking problem. The material must in essence respond like paper. It must not only have greater cutability but it must have high hinging strength and durability as well as great foldability and less "memory," a characteristic known in the art as "deadfold." When the material is folded, it needs to stay folded so that when it is turned under the backing board, it will stay down with normal glue and will not tend to pull away from contact with the glue and the backing board. To date, it has been difficult to produce a polypropylene sheet which will work with high speed binder machines, i.e., machines producing on the order of one hundred binders or binder cases per minute.

Other qualities which the material must have are freedom from pucker and from the production of a craze or whitening at the fold, and it should have a long shelf life and aging characteristics which will prevent it from cracking or otherwise deteriorating after manufacture.

SUMMARY OF THE INVENTION

In a casing (such as a binder or book casing) having at least one stiff panel portion, a thermoplastic sheet is provided for covering the panel portion or portions with the end and/or edge portions of the sheet being adapted to be folded under and secured to the underside of said panel portions. The thermoplastic sheet comprises between about 30% and about 55% copolymer of propylene and ethylene (preferably over 95% of the copolymer being propylene), 0% to about 12% propylene homopolymer (preferably between 9–10%), between about 0% to about 20% high density polyethylene; between about 23% to about 35% filler such as calcium carbonate or talc in a polyolefin carrier (preferably containing between about 40% and about 70% calcium carbonate or talc between about 30% and about 60% of a polyolefin); and about 3% to about 6% of a color concentrate (preferably containing approximately 50% color solids and about 50% linear low density polyethylene carrier). A sheet made using this formulation has been found to work exceptionally well in very high speed machines for making binder casings (i.e., machines for producing on the order of about 100 casings per minute). Sheets produced using this formulation have excellent aging qualities and stability, reduced elongation, increased deadfold, substantially improved cutability, resistance to crazing, and high hinging strength and durability. The copolymer of propylene and ethylene appears to improve the cutability and folding qualities of the material; the polypropylene homopolymer appears to improve the abrasion resistance and reduce tearing; the high density polyethylene appears to improve the strength and the corona treatment; the linear low density polyethylene appears to improve the tear strength; and the low density polyethylene appears to take the orientation out and provide a more noncrystalline material thereby also improving the cutability of the material.

A BRIEF DESCRIPTION OF THE DRAWINGS

DETAILED DESCRIPTION OF THE PREFERRED EMBODIMENT

Figure 1:
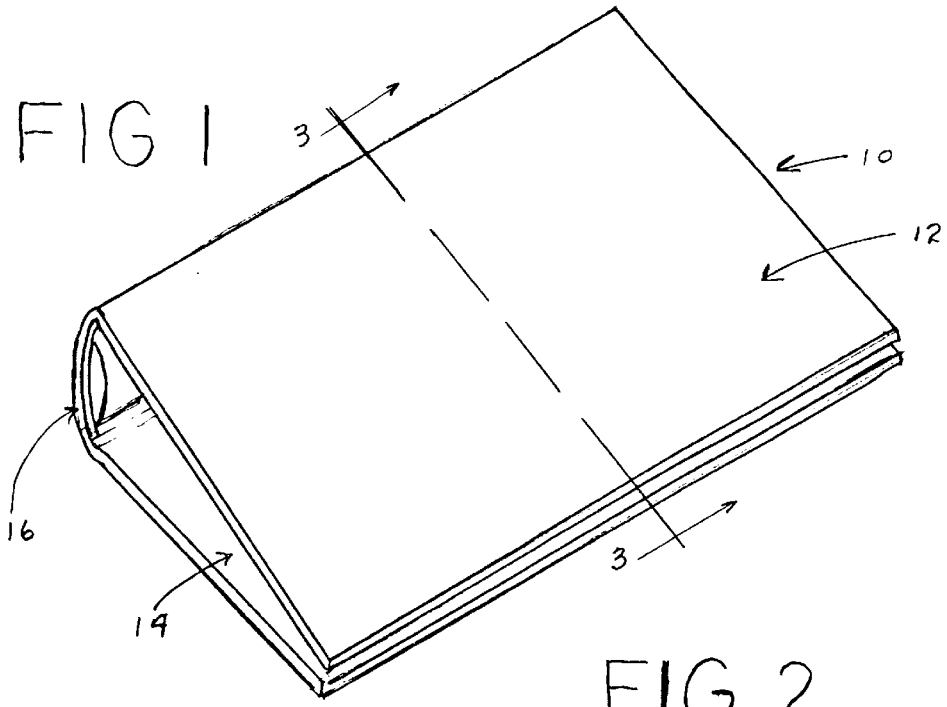
FIG. 1 is a perspective view of a ring binder having a cover constructed in accordance with the present invention.

In FIG. 1 there is illustrated a 3-ring binder 10 having a top cover 12, a bottom cover 14, a back 16, to which the top and bottom covers are hinged, and a binder mechanism 18.

Figure 2:
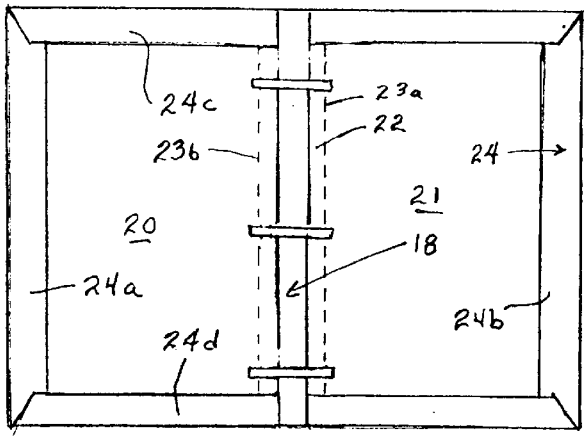
FIG. 2 is a top plan view of the binder with the front cover opened and showing the stiff side panels and the folding under and attachment of the edges of the cover sheet thereto.
Figure 3:
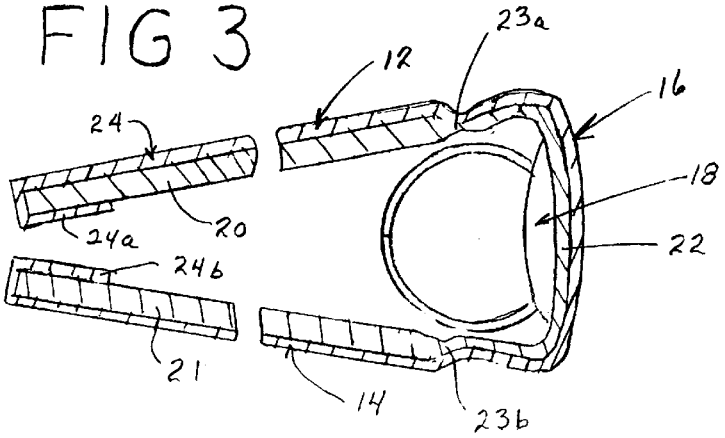
FIG. 3 is a sectional view taken substantially along line 3—3 of FIG. 1.

In FIG. 3 the details of this construction are illustrated more fully. The cover for the binder consists of a stiff panel portion 20 for the top cover 12, another stiff panel portion 21 for the bottom cover 14 and a stiff panel portion 22 for the back 16. The panel portions 20, 21 and 22 may be separate or they may be and preferably are portions of a single large panel which is scored at the junctures 23*a* and 23*b* of the panel portions to provide hinging between the portions. The stiff panel portions 20, 21 and 22 are preferably formed of cardboard, although they could be formed of any one of a number of stiffening materials. Covering the outer portion of the stiff panel portions 20, 21 and 22 is a covering sheet 24, having end portions 24*a* and 24*b* and edge portions 24*c* and 24*d* which are preferably turned under and glued to the underside of the stiff panel portions 20, 21 and 22 as best illustrated in FIG. 2. Thus the cover sheet 24 may provide additional hinging between the back 16 and the top and bottom covers 12 and 14. Stiffening for the back portion 16 could have been provided by the rear most portion of the ring binder mechanism 18 although in the illustrated embodiment a stiff panel portion 22 is provided as an integral part of the large panel.

The selection of the outer covering sheet 24 is most important because such binders are produced on high speed machines which produce between 80 and 120 binder casings per minute. The cover material must not only project a high quality and finished appearance, but it must be capable of being easily cut, forming a smooth and wrinkle free and long lasting hinge with the back and it must be capable of being turned under and glued to the stiff panels. Indeed, it must have many other properties which will be further discussed.

The material of the covering sheet 24 in accordance with this invention is a polypropylene based material having a quantity of a filler such as calcium carbonate or talc mixed into it in such a way that the sheet will extrude well, cut well, be easily heat sealable and yet not stick to the hot lettering stamp which may be used to put decorative or informative material onto the face of the binder.

It has been found that a thermoplastic sheet comprising between about 30% about 55% copolymer of propylene and ethylene (preferably over 95% of the copolymer being propylene), 0% to 12% propylene homopolymer (preferably over 95% of the copolymer being propylene), 0% to 12% propylene homopolymer (preferably between about 9% and about 10%), between about 0% and about 20% high density polyethylene (preferably between about 9% to about 20%) and between about 23% to about 35% filler such as calcium carbonate or talc in a polyolefin carrier. The carrier for the filler may, for example, be low density polyethylene or may be a copolymer of propylene and ethylene having over 95% of the copolymer being propylene. The filler is preferably between about 40% and about 50% loading, that is, it contains between about 40% and 50% talc or calcium carbonate with the remainder being the carrier. In order to achieve the coloring of the material, which would otherwise be translucent, between about 3% and about 6% of a color concentrate is added to the mix. The concentrate preferably contains about equal parts of color solids and a polyolefin carrier. The preferred polyolefin is linear low density polyethylene. The calcium carbonate or talc filler and the polyolefin carrier are introduced in the form of pellets and these are mixed for about 15 minutes with pellets of the propylene-ethylene copolymer, and, where the formula calls for it, with pellets of the propylene homopolymer and/or with pellets of high density polyethylene. These pellets are mixed for about 15 minutes in, for example, a 3000 pound Brower mixer and the mix is then transferred to a 14½ inch 24:1 extruder in which the mixture is heated and the constitutes are blended together as they are brought up to an extruding temperature of about 520° F. The molten blend is then cast is a 3 to 12 m sheet (preferably about 4½ m). One polypropylene copolymer which has been found quite acceptable is sold by Amoco Corporation under the trademark AMOCO 8449. This copolymer contains at least 95% propylene and no more than 5% ethylene and has a melt index of 11. Another copolymer that has been found quite acceptable is sold by the Fina Corporation under the mark FINA 7525MZ. This also is at least 95% propylene and the remainder ethylene and has a melt index of 10.0. It is preferred that between about 9% and 10% of the mixture be a propylene polymer and one quite acceptable product has been that produced by the Amoco Corporation under the mark AMOCO 6345. This propylene homopolymer has a melt index of 3.0. Where a high density polyethylene is used in the formula, it has been found that Chevron Chemical Company's CHEVRON LX 8055 works quite satisfactorily. This is a product having a melt index of 8.0. An acceptable pelletized mixture of about 50% talc and about 50% low density polyethylene carrier is POLYFIL AB4000MT. It is preferred, however, that a 40% loading for the talc be used. In instances where the formula contains high density polyethylene, this talc may employ a low density polyethylene carrier and one such product is POLYFIL MT-12. Where, however, the polyethylene component of the mixture is substantially reduced to less than 5% of the total formulation, the talc may be carried in a polypropylene copolymer carrier and a satisfactory product has been found in POLYFIL ABC4000 AGCPP-F.

In the production process known as the "cast embossed process" the molten blend exits the extruder in a sheet form out of a flat die and is cast onto a steel engraved roll. In order to cool and complete the finish of the material there is provided a wet nip in the engraving roll in which a rubber back up roller rotates in a water pan and then forms a pool of water before the nip. This puts a bright shiny finish to the underside of the film while the engraved roll puts a matt, sand, linen or other desired finish on the top side of the film.

The following are examples of the various mixtures and blends which have been extruded:

EXAMPLE 1

41 pounds of AMOCO 8449 propylene and ethylene copolymer (having a melt index of 10.0) was mixed with 9 pounds of Amoco 6345 propylene homopolymer (having a melt index of 3.0), 9 pounds CHEVRON LX8055 high density polyethylene (having a melt index of 8.0), 35 pounds of POLYFIL AB-4000MT which is a pelletized mixture of about 50% talc and about 50% low density polyethylene carrier. To this mixture was added 6 pounds of a color concentrate constituting about 50% color solids and about 50% linear low density polyethylene carrier. These materials were mixed in a Brower mixer and then transferred to a 24-to-1 screw extruder where the mixture was heated to 520° F. and extruded through a slot die to form a sheet 4.5 mils in thickness which was cast onto a steel engraving roll having a wet nip. The resultant sheet was rolled and was used in a high speed machine for producing casings by applying the sheet to backing boards for the formation of casings for three ring binders. The material was cut as it was applied to the backing and the edges were folded and glued to the interior of the casing. The casing machine was run at speeds between 80 and 120 casings per minute.

EXAMPLE 2

34 pounds of AMOCO 8449 copolymer of propylene and ethylene (having a melt index of 11.0, 10 pounds of AMOCO 6345 propylene homopolymer and 20 pounds of CHEVRON LX8055 high density polyethylene were mixed with 30 pounds of a pelletized mixture of calcium carbonate and a low density polyethylene carrier (about a 50—50 mixture). To this was added 6 pounds of a color concentrate in pellet form, constituting about 50% color solids and about 50% linear low density polyethylene carrier. The materials were mixed and extruded as in Example 1. The sheet material was found to work quite satisfactory in a high speed machine for producing ring binder casings.

EXAMPLE 3

32 pounds of AMOCO 8449 copolymer of propylene and ethylene was mixed with 9 pounds of AMOCO 6345 propylene homopolymer and 18 pounds of CHEVRON LX8055 high density polyethylene. To this mixture was added a pelletized mixture of 35 pounds of a POLYFIL AB4000MT talc (approximately 50% talc and 50% low density polyethylene carrier) and 6 pounds of a color concentrate constituting about 50% color solids and about 50% linear low density polyethylene carrier. The materials were mixed and extruded as in Example 1. The sheet produced using this material was found to be easy to cut and to work quite satisfactorily in a high speed machine for producing casings for three ring binders.

EXAMPLE 4

The same components as used in Example 3 were used in the same amounts except the filler was POLYFIL MT-12

(approximately 40% talc and 60% low density polyethylene carrier). The materials were mixed and extruded as in Example 1. The sheet produced was found to work quite satisfactorily in a high speed machine for producing casings for ring binders.

EXAMPLE 5

52 pounds of FINA 7525MZ copolymer of propylene and ethylene (containing about 95% propylene and with a melt index of 10.0 was mixed with 9 pounds of AMOCO 6345 propylene homopolymer and 33 pounds of POLYFIL ABC4000 AGCPP-F which is a pelletized mixture of about 40% talc in a copolymer of propylene and ethylene (containing about 95% propylene). To this mixture was added about 6 pounds of a color concentrate consisting of about 50% color solids and about 50% linear low density polyethylene carrier. The materials were mixed and extruded as in Example 1. This formulation was found to produce sheets which maintained the ease of cutting of the Example 3 formulation while providing a greatly improved heat weldable seal. The sheets worked quite satisfactorily in a high speed machine for producing casings for ring binders.

Table 1 gives a summary of the formulations used in the five foregoing examples. As can be seen, the formulation can be without any high density polyethylene (with a corresponding increase in the copolymer) and it has been found that the same is true of the propylene homopolymer although it is preferred to have this component present in the range of about 9% to 10%. Assuming a 95 to 5 propylene to ethylene distribution in the copolymer, the table shows that the polyethylene component of the mixture can range between about 44% to about 3%.

TABLE 1

| | Ex. 1 | Ex. 2 | Ex. 3 | Ex. 4 | Ex. 5 |
|---|---|---|---|---|---|
| Polypropylene copolymer | 41 | 34 | 32 | 32 | 52 |
| Propylene homopolymer | 9 | 10 | 9 | 9 | 9 |
| HDPE | 9 | 20 | 18 | 18 | — |
| Filler | | | | | |
| 50% Talc/LDPE | 35<br>17.5/17.5 | | 35<br>17.5/17.5 | | |
| 40% Talc/LDPE | | | | 35<br>14/21 | |
| 40% Talc/copolymer | | | | | 33<br>13.2/19.8 |
| 50% $CaCO_3$\LDPE | | 30<br>15/15 | | | |
| Color Concentrate | | | | | |
| 50/50 color solids\ | 6 | 6 | 6 | 6 | 6 |
| LLDPE | 3/3 | 3/3 | 3/3 | 3/3 | 3/3 |
| % PE component | 31.5 | 39.7 | 40.1 | 43.6 | 3.6 |

The sheets produced in all of the five foregoing examples exhibited increased hinging, deadfold, cutability and punchability properties and were easily glued at high speeds. The sheets had reduced crazing, pucker and elongation and the shelf life and resistance to aging deterioration were markedly increased, as was scruff resistance. The energy needed to cut the sheets, as measured by the ASTM D882 Total Energy test and which is the total area under the curve on the tensile strength graph at the end of the test, was found to be between about 230 and 270 inch pounds, which is 50% less than that of the best available prior art polypropylene cover sheet used as the covering material for hardback books as described in Pat. No. 5,224,737.

It is preferred that the Total Energy values be below 290 inch pounds because with higher values the film will be difficult to cut. Preliminary investigations indicate that increasing the propylene homopolymer much above 9–10% by weight will increase the Total Energy whereas decreasing it will increase "crazing" and decrease favorable foldability. Decreasing the filler component will increase Total Energy values and make the film more difficult to cut.

The abrasion resistance, as measured by Stohl Abrasion test # 191A of the Manufacturing Standards and Specifications for Textbooks of the National Association of State Textbook Administrators, was between about 225 and about 300 cycles. The sheets exhibited tear strength of between about 110 and about 140 pounds in the machine direction and between about 65 pounds and about 70 pounds in the cross or transverse direction, as measured by the Elmendorf Federal Test Method Standard No. 191A, Method 5132 for cloth tearing strength.

This sheet material is not only an excellent material for producing binder covers including covers for ring and lever arch binders, but is useful in covering other products such as, for example, slip cases, books, box files and drop-side and expanding boxes. As used herein, the word "casing" is intended to cover all stationers products in which a cover sheet is affixed over a stiffener or filler board.

The foregoing description has been given by way of an example and certain modifications may be made therein without departing from the spirit and scope of the invention as herein claimed.

What is claimed is:

1. In a casing having at least one stiff panel portion, a thermoplastic cover sheet enveloping the exterior of said panel portion and folded under and secured to the underside of said panel portion, said cover sheet comprising between about 30% to about 52% by weight of a copolymer of propylene and ethylene, between about 0% to about 12% by weight propylene homopolymer, between about 9% to about 20% by weight high density polypropylene, and between about 23% to about 35% by weight filler.

2. The structure of claim 1 and further including between about 3% to about 6% by weight of a color concentrate.

3. The structure of claim 2 wherein said color concentrate contains about equal proportions by weight of color solids and a linear low density polyethylene carrier.

4. The structure of claim 1 wherein over about 95% by weight of the copolymer is propylene.

5. The structure of claim 1 wherein propylene homopolymer is present in an amount of between about 9 and about 10 percent by weight.

6. The structure of claim 1 wherein said filler is selected from the group consisting of calcium carbonate and talc in a polyolefin carrier.

7. The structure of claim 1 wherein said filler is between about 30% to about 60% by weight of a low density polyethylene and between about 40% to about 70% by weight of a material selected from the group consisting of calcium carbonate and talc.

8. In combination with a casing having at least one stiff panel portion, a thermoplastic sheet covering one side of said panel portion and having edges folded under and adhesively secured to the opposite side of said panel portion, said sheet comprising between about 30% to about 55% by weight of a copolymer of propylene and ethylene, between about 0% to about 12% by weight propylene homopolymer, between about 0% to about 20% by weight of a high density polyethylene between about 23% to about 35% over by weight of a filler consisting of between about 40% and about 50% by weight of a material selected from the group of calcium carbonate and talc and between about 50% and about 60% by weight of a polyolefin carrier, the propylene component of said copolymer being at least 95%.

9. The structure of claim 8 wherein the ethylene component of the sheet being between about 44% and about 3%.

10. The structure of claim 9 wherein the ethylene component of the sheet is less than 5%.

11. In a casing having a pair of stiff side panel portions and a back portion, a thermoplastic sheet for covering said side panel portions and said back portion and forming a hinge between said back and panel portions, said sheet being formed by mixing and extruding between about 50% and about 55% by weight of propylene-ethylene copolymer containing at least 95% by weight propylene, between about 5% to about 15% by weight of a propylene homopolymer, between about 25% to about 40% by weight of a filler containing about 40% by weight talc and about 60% by weight of a propylene-ethylene copolymer carrier containing at least 95% by weight propylene.

12. A process for forming a thermoplastic sheet which is adapted to be applied to stiff backing boards, said process comprising the steps of mixing between about 30% to about 55% by weight of a copolymer of propylene and ethylene with between about 0% and 12% by weight propylene homopolymer, between about 0% to about 20% by weight high density polypropylene, and between about 23% to about 35% by weight filler and extruding the mixture to form a sheet.

13. The process of claim 12 wherein over about 95% by weight of the copolymer is propylene.

14. The process of claim 12 wherein the propylene homopolymer is present in an amount of between about 9% and about 10% by weight.

15. The process of claim 12 wherein said filler includes between about 40% and about 50% by weight of a material selected from the group consisting of calcium carbonate and talc and between about 50% to about 60% by weight of a polyolefin carrier.

16. The process of claim 15 wherein the polyolefin component of the filler is selected from the group consisting of low density polyethylene and a copolymer of propylene and ethylene, with propylene comprising at least 95% by weight of the copolymer.

17. The process of claim 9 wherein the total polyethylene component in the sheet from all sources is less than 5% by weight.

* * * * *